US005737804A

United States Patent [19]

Ferrari et al.

[11] Patent Number: 5,737,804

[45] Date of Patent: Apr. 14, 1998

[54] FURNITURE HINGES WITH CAM ADJUSTMENT SYSTEM

[75] Inventors: Franco Ferrari, Frazione Deviscio, 2, 22053 Lecco; Carlo Migli, Lecco, both of Italy

[73] Assignee: Franco Ferrari

[21] Appl. No.: 767,093

[22] Filed: Dec. 16, 1996

[30] Foreign Application Priority Data

Dec. 22, 1995 [IT] Italy ..... MI95A2742
Feb. 14, 1996 [IT] Italy ..... MI96A0281

[51] Int. Cl.[6] ..... E05D 7/04; E05D 11/10

[52] U.S. Cl. ..... 16/242; 16/246; 16/335

[58] Field of Search ..... 16/335, 235, 238, 16/240, 242, 245, 246, 272, 368, 369, 243, 244, 284, 303, 296; 411/273, 272; 408/173, 178

[56] References Cited

U.S. PATENT DOCUMENTS

| | | | |
|---|---|---|---|
| 4,493,129 | 1/1985 | Grass | 16/238 |
| 4,549,831 | 10/1985 | Lautenschlager, Jr. | 16/238 |
| 4,716,622 | 1/1988 | DeBruyn | 16/335 |
| 5,027,474 | 7/1991 | Bowers | 16/335 |
| 5,307,539 | 5/1994 | Bauman | 16/235 |
| 5,392,493 | 2/1995 | Youngdale | 16/335 |
| 5,603,142 | 2/1997 | Dubach et al. | 16/235 |

*Primary Examiner*—Chuck Mah
*Attorney, Agent, or Firm*—Shlesinger, Fitzsimmons & Shlesinger

[57] ABSTRACT

A furniture hinge comprises a first (11) and a second (12) fastening element designed to be secured to two furniture parts to be hinged together, and an arm (15) which ends at one extremity with the first fastening element (11) and at the other extremity has a pivot (16) pivoting it to the second fastening element (12) to achieve the joint of the hinge. The arm (15) is made in two portions (17, 18) sliding reciprocally upon operation of adjusting means (22) composed of a cam (23) to allow adjustment of the reciprocal position of the first and second fastening element. Advantageously, the sliding surface (20) of the second portion (18) comprises an elongated housing (24) to receive the cam (23) with a lateral surface of the cam which reacts against the side walls of the housing. The sliding surface (19) of the first portion (17) comprises a through hole (25) which receives, with a minimum of side play, a control pin (26) protruding from the cam so as to be operated from the outside.

16 Claims, 3 Drawing Sheets

FURNITURE HINGES WITH CAM ADJUSTMENT SYSTEM

BACKGROUND OF THE INVENTION

This invention refers to furniture hinges with a lateral adjusting device and in particular to single-pin cup type automatic hinges.

Cup-type invisible hinges characterized by a single pivot have been widely used for some time now. In their simplest embodiment they are composed of four main components: a fixed portion or wing (designed to be integrally secured to the side of the furniture unit), a movable portion or box (designed to be integrally secured to the door), a pivot and a spring to ensure automatic closing. These simple hinges do not allow for any adjustment between the fixed portion and movable portion in order to ensure adjustability of the covering of the side panel by the door, hinges of the above-mentioned type have been proposed, in which the wing is made in two pieces, one of which bears the fastening means for fastening it to the side panel and the other bears the pivoting with the box. The two pieces are connected by means of a screw screwed into one of them and fitting with its shank into an elongated aperture in the other.

When the screw is loosened the two pieces can slide reciprocally, thereby permitting adjustment, The subsequent retightening of the screw locks the pieces in the desired position.

However, the adjustment is difficult and imprecise. In fact, when the fastening screw is loosened the two portions are free to slide along the entire length of the elongated aperture, and the desired degree of coverage of the side panel can only be found by trial and error. The adjustment is also hampered by the fact that the hinges are burdened with the weight of the door which tends to make the two parts slide inappropriately as soon as the fastening screw is loosened.

Moreover, when the hinge is closed, the head of the screw protrudes inside the box in a central position, creating an obstruction which could be critical for housing the closing mechanism of the hinge.

The general scope of this invention is to obviate the aforementioned problems by providing a hinge having a fine adjustment which is easy to operate and of limited dimensions.

SUMMARY OF THE INVENTION

This scope is achieved, according to the invention, by providing a furniture hinge comprising a first and a second fastening element designed to be secured to two furniture parts to be hinged together, and an arm which ends at one extremity with the first fastening element and at the other extremity has a pivot pivoting it to the second fastening element to achieve the joint of the hinge, the arm being made in two parts sliding reciprocally upon operation of adjusting means to allow adjustment of the reciprocal position of the first and second fastening element, characterized by the fact that the adjusting means comprise a cam with axis of rotation pivoted to the first part and a cam surface reacting against the second part to achieve said adjustment upon rotation of the cam.

A further scope of this invention is to provide an adjustment of the aforesaid type comprising a cam devoid of instability and which permits uniform and precise adjustment at any point of the adjustment stroke. This further scope is achieved, according to the invention, by providing cam adjusting means in which, for any angular position of the cam in its active stroke around the axis, the centre of rotation of the cam is substantially within the region of a straight line passing through a point of contact between a lateral surface of the cam and a bearing surface of the second element, said straight line being slanted by an angle $\Phi$ identical to the angle of friction in the point of contact.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figure 1:
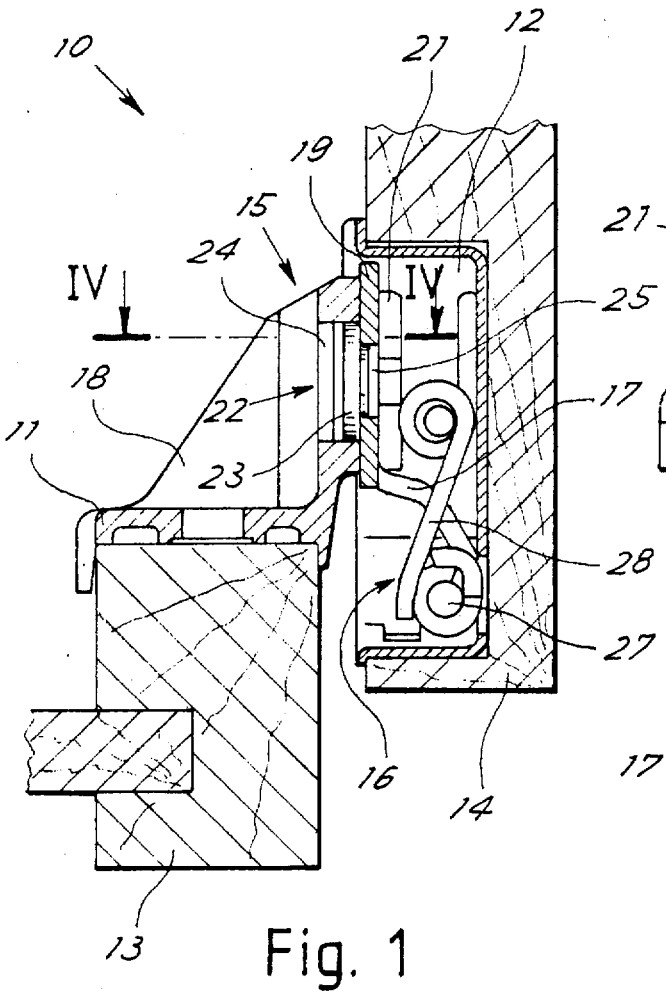
FIG. 1 shows a partial cutaway side view of a hinge made according to the invention.

With reference to the figures, a hinge 10, made according to the invention, comprises a first and a second fastening element, respectively indicated by 11 and 12, designed to be secured to two furniture parts 13, 14 to be hinged together. For example, the two furniture parts can be, respectively, a side panel and a door of a furniture unit. The hinge comprises an arm 15 which ends at one extremity with the first fastening element 11 and at the other extremity with a pivot 16 pivoting it to the second fastening element to achieve the joint of the hinge. FIG. 1 shows the closed position of the hinge, the open position being obvious to the expert in the field on the basis of the aforesaid figure.

The arm 15 is composed of two parts 17, 18 which slide reciprocally to enable the adjustment of the reciprocal position of the first and second fastening element. In particular, the first and second part have reciprocal sliding parts and sections 19, 20 which overlap each other. Advantageously, the second part 18 comprises lateral sides walls or edges 21 which are disposed facing each other on opposing sides of the sliding section 20 and are shaped to form a guide channel which slidingly receives the sliding section or wing 19 of the first part 17. In this way, the first part can slide exclusively in a longitudinal direction along the second part.

The first part 17 comprises the pivot 16 securing it to the second fastening element 12 and the second part 18 is L-shaped, one arm of the L forming the first fastening element 11 and the other arm of the L forming the sliding section 20.

The second fastening element 12 is advantageously made in the form of a cup or box recessed so as to contain the pivot, made with a single pin 27 around which the pivot end of part 17 is wound.

The cup can also contain a spring 28 reacting between the cup and the pivot to define stable open and closed positions of the hinge, as is well know to the expert in the field.

As can be clearly seen in FIG. 1, when the hinge is in the closed position the arm of the L forming the sliding section 20 is disposed parallel to and facing the bottom of the cup 12 and the first part 18 of the arm is contained in the cup.

According to the invention, disposed between the first and second part are cam adjusting means 22 comprising a cam 23.

Figure 2:
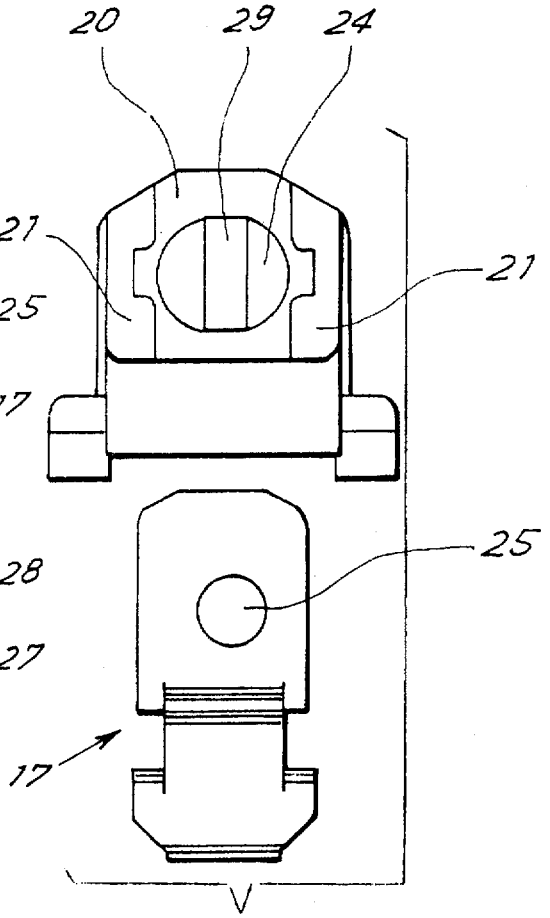
FIG. 2 shows an exploded view of two arm parts of the hinge of FIG. 1.

As is also clearly shown in FIG. 2, the sliding section 20 of the second part 18 comprises an elongated cam housing or slot 24 for receiving the cam 23 so that the lateral surface of the cam can react against lateral walls of the housing. The sliding section 19 of the first part 17 comprises a through hole 25 which receives, and has rotable therein, a pivot 26 protruding from the cam to define the axis of rotation of the cam. As can be clearly seen in FIG. 3, the pivot 26 has an upper end which faces out from the first part 17 to constitute the operating end (for example, by means of a screwdriver) of the cam. The cam can be shaped, for example, in the form of a flat disk with a diameter slightly smaller than the smallest dimension of the slot 24. The misalignment between cam disk and pivot 26 is identical to or slightly smaller than the difference between the maximum and minimum dimension of the slot. Said misalignment is equivalent to half the maximum desired adjusting stroke.

It can be clearly seen that when the hinge is in the closed position, there is no further obstacle caused by the cam in the cup.

Figure 3:
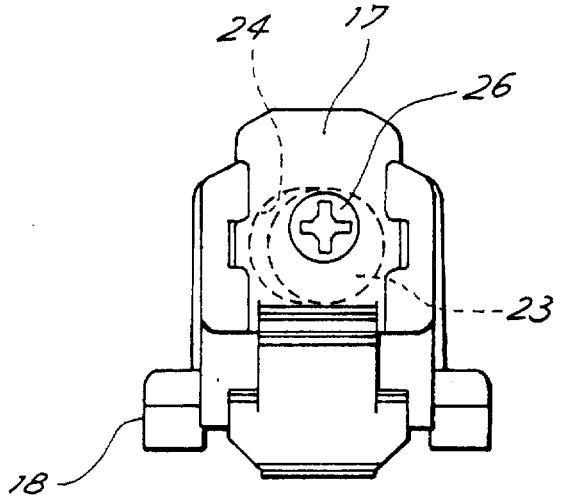
FIG. 3 shows a view of the two parts of FIG. 1, coupled together.

The effect of the rotation of the cam, which has an axis of rotation pivoted to the first part and cam surfaces reacting against the second part, is obvious from FIG. 3. It is thus possible to achieve a precise and easy adjustment of the reciprocal position of the first and second element. Thanks to the use of a cam, no further locking means are necessary between the first and second part of the arm. Moreover, the first and second parts are never free to slide indiscriminately with respect to each other.

Figure 4:
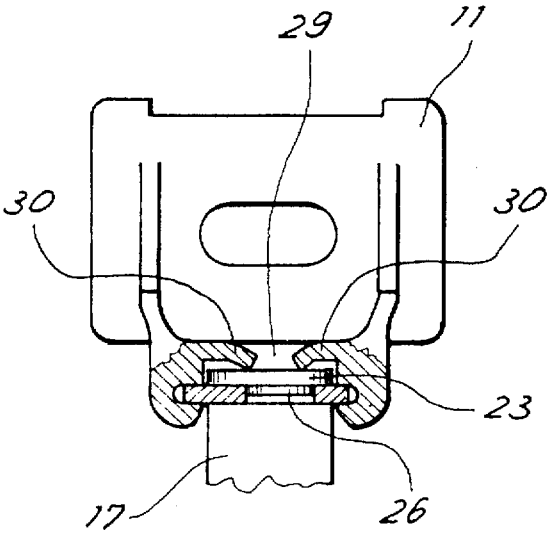
FIG. 4 shows a partial cutaway view along the line IV—IV of FIG. 1.

FIG. 4 shows in detail a possible embodiment of the slot 24 to facilitate assembly of the parts 17 and 18 of the arm 15 with the cam between them. In particular, the slot is made deeper than the thickness of the cam including the pivot 26, and the bottom of the slot has an incision 29 which divides it into two lateral wings 30 sufficiently pliable to be bent towards the inside of the slot by exerting the appropriate pressure.

The assembly begins with the complanate wings 30. First the cam is inserted inside the slot so that the cam rests on the bottom of the slot. Since the overall thickness of the cam is small than the depth of the slot, the sliding wing of part 17 can be inserted without hindrance into the guide channel between the edges 21, after which the cam is pushed with a tool (not shown) passing through the slit. 29, so as to position the pivot 26 in the through hole 25. At this point the cam can be locked in place by bending the wings 30 inwards (for example by riveting) to bring them into the position shown in FIG. 3.

The foregoing description of an embodiment applying the innovative principles of this invention is obviously given by way of example in order to illustrate such innovative principles and should not therefore be understood as a limitation to the sphere of the invention claimed herein. For example, in order to fulfill particular requirements, the hinge may have a shape differing from the one shown. Moreover, the assembly of the sliding parts and the cam can be made different from that shown. For example, the cam can be secured in the housing by means of screws instead of by bending the bottom of the housing. Lastly, the cam can have a shape different from the circular one shown as an example.

Figure 5:
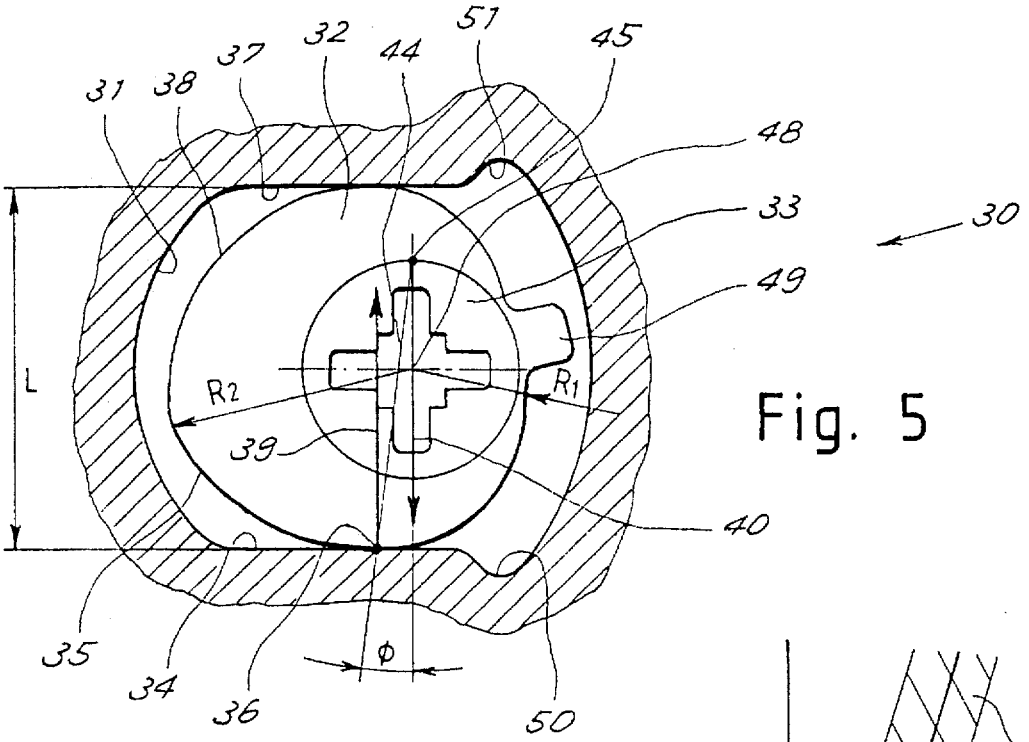
FIG. 5 shows a schematic view of a cam adjusting device made according to the invention.

FIG. 5 schematically shows a cam adjusting device, generically indicated by 30, for adjusting the position between a first part, integral with a slot 31 containing a cam 32, and a second part integral with a housing (not shown) for rotation of a pivot 33 controlling the cam 32. The housing 31 comprises an internal lateral surface 34 against which reacts a corresponding lateral surface 35 of the cam 32. The surface 34 of the housing has a substantially rectilinear section tangent to the point of support 36 upon it on which the surface 35 of the cam rests. A second internal lateral surface 37 of the housing is disposed facing the surface 34 of the housing so as to have a rectilinear section substantially parallel to the rectilinear section of the first surface and to constitute a support for a second lateral surface 38 of the cam. As will be clear from the examples described further on, the housing of the pivot is obliged to move in a direction perpendicular to the planes 34 and 37.

Upon rotation of the cam around the axis 48 of the pivot, the axis itself oscillates between an upper position of maximum distance from the lower wall 34 of the housing (reached when the cam has its maximum radius R2 in point 36) and a lower position of minimum distance from it (reached when the cam has its minimum radius R1 in point 36). In FIG. 5, the cam is represented in an intermediate position.

Acting on the cam are a force of action, indicated by the arrow 39, applied in the point 36 of contact between the body of the cam and the lower wall of the housing, and an identical and opposing force of reaction, indicated by the arrow 40, which acts between the pivot 33 and its housing and which can be considered as passing through the centre of the pivot.

In the known cam adjusting devices, for example comprising a cylindrical cam body, the lines of application of the forces of action and reaction coincide when the cam is in one of the extreme upper or lower positions, while they are misaligned in the intermediate positions. In this situation, the two forces generate a torque which tends to rotate the eccentric towards the dead centre. The friction between the cam and its housing and between the pivot and its housing contrast said torque, but in some conditions the torque can become excessive and the cam rotates spontaneously towards the dead centre.

The most disadvantageous condition is when the cam is half way through the adjustment, since in this situation the misalignment between the forces of action and reaction is at its maximum. Consequently, in order to prevent spontaneous rotation it is necessary to ensure that in this position the torque does not exceed the maximum value beyond which spontaneous rotation occurs. This, however, sets a limit to the maximum adjustment possible for a cylindrical cam in relation to its size.

This is the main reason why the problem is even more serious whenever considerable adjustments are required compared to the space available for housing the eccentric. According to the innovative principles of this invention, it has been found that if the centre of rotation of the cam moves along a particular straight line or sheaf of straight lines instead of, for example, along an arc of a circumference as occurs for the cylindrical cams, it is possible to maximize the amplitude of the adjustment without encountering instability.

Figure 6:
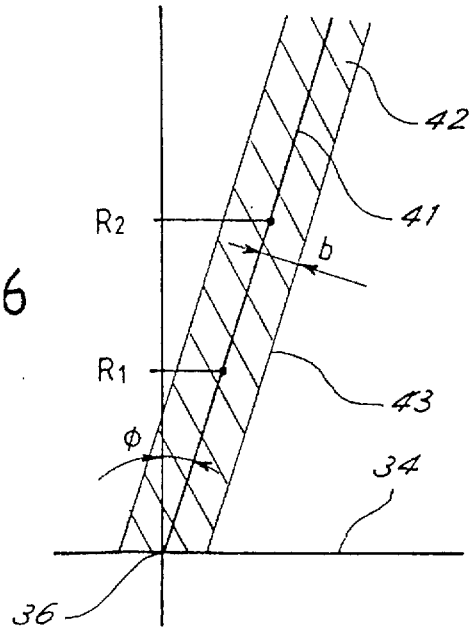
FIG. 6 shows a graph illustrating a condition that the centre of rotation of the cam must fulfill according to the invention.

FIG. 6 shows a graph which explains this. The horizontal axis coincides with the surface 34 tangent to the surface of the cam. The vertical axis represents the perpendicular at the tangent point 36. The straight line 41 is the line of friction, that is to say the line which crosses through the tangent point 36 and is slanted by an angle Φ with respect to the perpendicular, where Φ is the traditional angle of sliding friction between the cam and the bearing surface.

According to the invention, in any angular position of the cam along its active stroke, the centre of rotation of the cam must be substantially in the region of the line of friction as defined above. In other words, the centre of rotation of the cam must lie within a strip 42 containing the line of friction 41.

The best possible condition is when the centre of rotation is situated constantly on a boundary line 43, parallel to the line of friction and at a distance from it by a value $b=r*fp*\cos\Phi$, where r is the radius of the pivot 33 and fp is the friction coefficient of the contact between the pivot and its housing. The best possible condition is understood to mean the condition in which the maximum possible amplitude of the adjustment is achieved without any point of instability in the active stroke of the cam. Moreover, the raising of the pivot will be substantially proportional to the angle of rotation of the cam and consequently uniform adjustment will be achieved along the entire active stroke of the cam.

In the particular case of identical friction coefficients between the cam and its housing and between the pivot and its housing, that is to say when $fp=\tan\Phi$, then $b=r*\mathrm{sen}\Phi$. This means that the cam must be shaped in such a way that, as shown in FIG. 5, a segment 44 crossing through the tangent point 36 and the point 45 of the pivot which is furthest away from the surface 34 is slanted by the angle Φ with respect to the perpendicular to the surface 34. In other words, the best possible condition is achieved when, for any angle of rotation of the cam within its active stroke, the point 45 is situated on the line of friction 41. This makes tracing out the cam by points particularly easy.

In the case of a cam which, as shown in FIG. 5, rotates between two surfaces 34 and 37, by calculating the cam portion 35 which slides over the surface 34 so as to fulfill the rule indicated above, the cam portion 38 which slides over the surface 37 can be easily calculated by simply ensuring that the distance L between the surfaces 37 and 34 remains constant in the tangent points with the cam.

Figure 7:
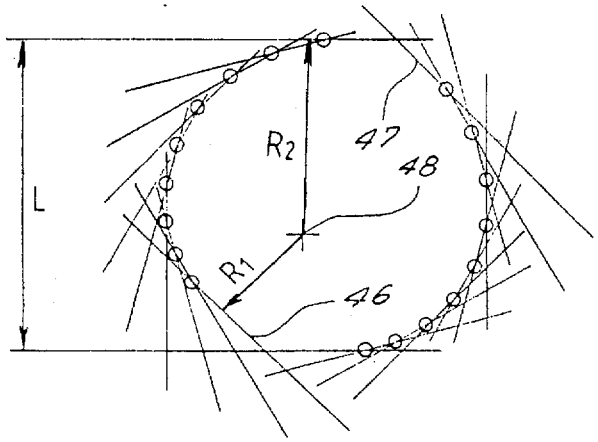
FIG. 7 shows a construction by points of a cam according to the invention.

A cam with an active profile 35 according to the invention can be identified reasonably accurately, disregarding the radius of the pivot, by the envelope of straight lines distant from the centre of rotation of the cam by a distance $Dn=Dn-1*\alpha P*\tan\alpha$, with Dn identical to the distance from the centre of the nth line, Dn−1 identical to the distance of the previous line to the nth line from the centre of the cam, αP identical to the angular pitch of calculation of the cam (that is to say: αP identical to the angle between the line n and the line n-1), α identical to the angle of inclination (in radians) between the tangent to the cam and the perpendicular to the line joining the tangent point to the centre of the cam. The angle α must be smaller than the angle of friction Φ between the cam and its housing. In particular, for the best possible condition $\alpha=\Phi$. The envelope of straight lines on the other profile 38 of the cam is obtained by tracing the parallel lines at a distance L from the lines of the first envelope. FIG. 7 shows the overall envelope.

Said envelope can be advantageously developed by an automatic calculation program.

With reference to FIG. 7, the first step in calculating the profile consists in tracing a straight line 46 at a distance Do from the axis 48 of rotation of the cam, corresponding to R1, that is to say at the minimum distance foreseen between the axis of rotation and one of the two walls of the housing bearing the cam. It is obvious that the profile can be traced by taking the distance from the lower wall or from the upper wall of the housing. From the opposite part with respect to the axis of rotation, a straight line 47 is then traced parallel to the line 46 and at a distance L from it. The lines traced are then made to rotate by the angle αP around the centre of rotation 48 of the cam. The new distance $D1=D*\alpha P*\tan\alpha$ is then calculated and the corresponding line rotated by the angle αP with respect to the previous line and the parallel line at distance L are traced. The construction of the envelope proceeds repeatedly in this way until it is observed that Dn>=R2, that is, until the desired amplitude of adjustment is achieved. This must obviously occur before a 180° profile is traced. It is clear that to ensure better precision in the determination of the cam profile it is necessary for the angle αP to be chosen sufficiently small.

At this point it is evident how a cam adjusting device according to the invention is achieved. The vicinity of the centre of the cam to the outermost line 43 obviously depends upon the tolerances used in constructing the device. In fact, it must be considered that going outside the strip 42 beyond the line 43 leads to the onset of instability in the adjustment. In general, it is consequently preferable to maintain the centre of rotation slightly more within the strip 42 along the entire adjustment stroke.

As can be seen in FIG. 5, in addition to the active profile as described above, it is advantageous for the cam to have a radially protruding shank 49 to constitute a limit stop to the rotation of the cam by its engagement in recesses 50, 51 in the housing 31.

Figure 8:
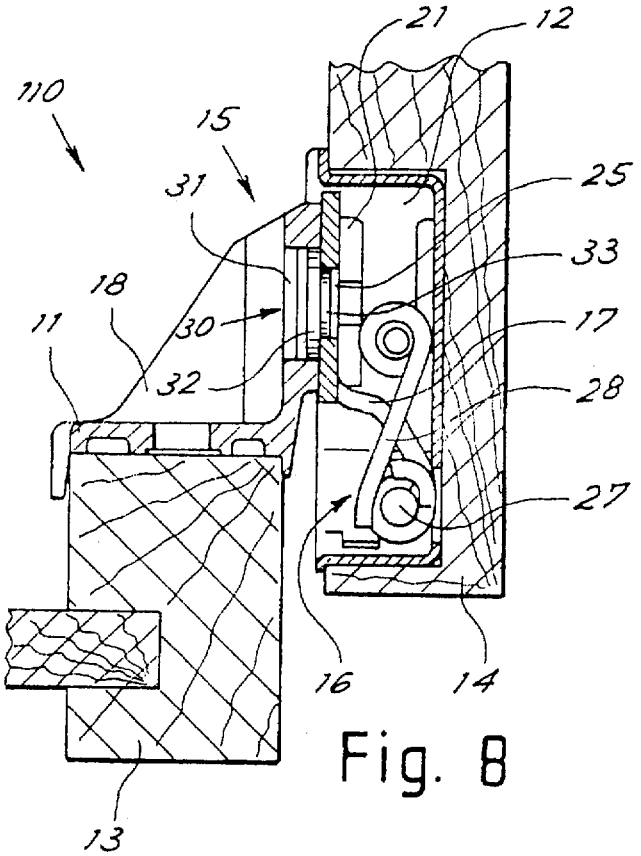
FIG. 8 shows a side elevation view, partially cutaway along the line VIII—VIII of FIG. 5, of a furniture hinge similar to the hinge of FIG. 1, but provided with the cam adjusting device according to FIG. 5.
Figure 9:
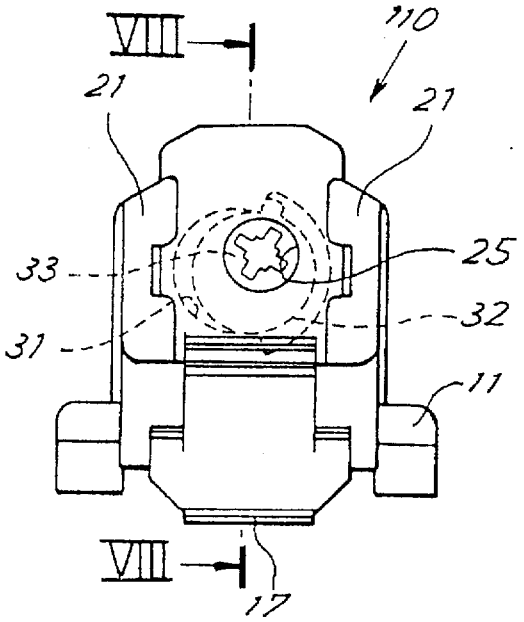
FIG. 9 shows a front scrap view of a hinge as in FIG. 1, but provided with the cam of FIG. 5.

FIGS. 8 and 9 show a furniture hinge, generically indicated by 110, made similar to the hinge of FIG. 1, but with the adjusting device described above. Parts similar to those of the hinge of FIG. 1 will be indicated using the same numbers as in FIG. 1, The hinge 110 comprises a first and second fastening element, respectively indicated by 11 and 12, designed to be secured to two furniture parts 13, 14, for example a side panel and the respective door, to be hinged together. The hinge comprises an arm 15 which ends at one extremity with the first fastening element 11 and at the other extremity with a pivot 16 pivoting it to the second fastening element to achieve the joint of the hinge. The arm 15 is composed of two reciprocally sliding parts 17, 18. The first part 17 comprises the pivot 16 securing it to the second fastening element 12 and the second part 18 is L-shaped, one arm of the L forming the first fastening element 11 and the other arm of the L forming the sliding surface for the first part 17. The sliding is guided by lateral edges 21 which form a guide channel which slidingly receives the sliding wing of the first part 17.

The second fastening element 12 is advantageously made in the form of a cup or box recessed so as to contain the pivot, made with a single pin 27 around which the pivoting end of part 17 is wound.

A spring 28 reacts between the cup and the pivot to define stable open and closed positions.

As can also be clearly seen in FIG. 9, where the cup has been removed for greater clarity, disposed between the first and second part are cam adjusting means 30, made according to the invention, comprising a cam 32, of the type shown in FIG. 5, pivoted, by means of a pivot 33 received in a housing 25, to part 17 so as to react against lateral surfaces of a housing 31 in part 18. As can be clearly seen in FIG. 9, the pivot has an upper end which faces out from the first part 17 to constitute the operating end (for example, by means of a screwdriver) of the cam. Upon rotation of the cam, part 17 slides with respect to part 18, thereby providing precise and stable lateral adjustment of the position of the door.

What is claimed is:

1. Furniture hinge comprising a first and a second fastening element designed to be secured to two furniture parts to be hinged together, and an arm which ends at one extremity with the first fastening element and at the other extremity has a pivot pivoting it to the second fastening element to achieve the joint of the hinge, the arm being made in two parts, and adjusting means interconnecting said two parts for sliding movement reciprocally relative to each other upon operation of said adjusting means to allow adjustment of the reciprocal position of the first and second fastening elements, in which the adjusting means comprise a cam with axis of rotation pivoted to the first part of the arm and a cam surface reacting against the second part of the arm to achieve said adjustment upon rotation of the cam.

2. Hinge as claimed in claim 1, characterized by the fact that the first and second parts have reciprocally sliding sections thereof overlapping each other.

3. Hinge as claimed in claim 2, characterized by the fact that the sliding section of the second part has therein an elongated cam slot to receive the cam with lateral surfaces of the cam reacting against lateral walls of the slot in said second part, and the sliding section of the first part comprising a through hole which receives and has rotatable therein a pivot protruding from the cam to define said axis of rotation, the pivot having its upper end facing the exterior of the first part to constitute an extremity for operating the cam.

4. Hinge as claimed in claim 3, characterized by the fact that the second part comprises a guide to slidingly receive the first part and that the cam has an overall thickness, including the pivot which protrudes from the cam, smaller than the depth of the cam slot to allow the first part to fit freely into the guide in the second part when the cam is positioned in the cam slot, the cam slot having a bottom formed by a yielding portion of the second part which is bent towards the inside of the slot to maintain the cam at a distance from the bottom of the slot and with the pivot inserted in the through hole when the first part is inserted in the guide on the second part.

5. Hinge as claimed in claim 2, characterized by the fact that the second part comprises edges disposed facing each other on opposite sides of the sliding section to form guides which slidingly receive the first part.

6. Hinge as claimed in claim 2, characterized by the fact that the first part comprises said pivot pivoting to the second fastening element and the second part is L-shaped, one arm of the L forming the first fastening element and the other arm of the L forming said sliding section of the second part.

7. Hinge as claimed in claim 6, characterized by the fact that the pivot is single-pin.

8. Hinge as claimed in claim 6, characterized by the fact that the second fastening element is a recessable cup and that in a closed position of the hinge the arm of the L which forms the sliding section is disposed substantially parallel to and facing the bottom of the cup and the first part is contained in the cup.

9. Hinge as claimed in claim 1, characterized by the fact that the second fastening element is a recessable cup which contains said pivot.

10. Hinge as claimed in claim 9, characterized by the fact that the cup contains a spring which reacts between the cup and the pivot to define stable open and closed positions of the hinge.

11. Hinge as claimed in claim 1, characterized by the fact that the cam is pivoted to the first part of the arm by means of a pivot rotating around said axis to react with one of its lateral surfaces against a bearing surface on the second part of the arm, for any angular position of the cam in its active stroke around said axis of rotation the centre of rotation of the cam is substantially in the region of a straight line passing through a point of contact between a lateral surface of the cam and a bearing surface on the second part of the arm, said straight line being slanted at an angle $\Phi$ identical to the angle of friction in the point of contact.

12. Hinge as claimed in claim 11, characterized by the fact that the centre of rotation is no further than $r*fp*\cos\Phi$ from said straight line, with r identical to the radius of the pivot of the cam and fp identical to the coefficient of friction between the pivot and its housing.

13. Hinge as claimed in claim 11, characterized by the fact that the centre of rotation is no further than $r*\mathrm{sen}\Phi$ from said straight line, with r identical to the radius of the pivot.

14. Hinge as claimed in claim 13, characterized by the fact that, for any angle of rotation of the cam within its active stroke, a point of the pivot which is furthermost from the bearing surface lies substantially close to said straight line.

15. Hinge as claimed in claim 11, characterized by the fact that the bearing surface forms part of a housing to laterally receive the cam which comprises a second surface of contact with the cam, opposite the first surface, first and second surfaces being parallel with each other in the respective points of contact with the cam.

16. Hinge as claimed in claim 1, characterized by the fact that the cam is defined by an envelope of straight lines spaced apart from the axis of rotation of the cam by a distance $Dn=Dn-1*\alpha p*\tan\alpha$, with Dn identical to the distance between axis of rotation and nth straight line, Dn-1 identical to the distance between straight line preceding the nth straight line and axis, $\alpha P$ identical to the angle between the straight line n and the straight line n-1, $\alpha$ being an angle smaller or identical to the angle of friction $\Phi$.

* * * * *